US006871886B2

(12) United States Patent
Coleman et al.

(10) Patent No.: US 6,871,886 B2
(45) Date of Patent: Mar. 29, 2005

(54) SASH LOCK

(76) Inventors: John D. Coleman, 2400 Market St., Philadelphia, PA (US) 19103; Raymond Hufnagle, 1777 Hylton Rd., Pennsauken, NJ (US) 08110

( * ) Notice: Subject to any disclaimer, the term of this patent is extended or adjusted under 35 U.S.C. 154(b) by 0 days.

(21) Appl. No.: 10/609,412

(22) Filed: Jul. 1, 2003

(65) Prior Publication Data

US 2004/0026932 A1 Feb. 12, 2004

Related U.S. Application Data

(60) Provisional application No. 60/402,059, filed on Aug. 9, 2002.

(51) Int. Cl.[7] ..... E05C 3/04

(52) U.S. Cl. ..... 292/241; 292/DIG. 47

(58) Field of Search ..... 292/240, 241, 292/13, 83, 85, 82, DIG. 20, DIG. 47, DIG. 73

(56) References Cited

U.S. PATENT DOCUMENTS

| | | | | | |
|---|---|---|---|---|---|
| 46,472 | A | * | 2/1865 | Jenks | 292/85 |
| 230,476 | A | * | 7/1880 | Green | 292/85 |
| 530,078 | A | * | 12/1894 | Ammerman | 292/85 |
| 562,104 | A | * | 6/1896 | Veer | 292/83 |
| 997,343 | A | * | 7/1911 | Troth | 292/83 |
| 1,235,075 | A | * | 7/1917 | Stamm | 292/85 |
| 2,896,988 | A | * | 7/1959 | Hitzelberger | 292/83 |

* cited by examiner

*Primary Examiner*—Gary Estremsky
(74) *Attorney, Agent, or Firm*—Jay M. Cantor

(57) ABSTRACT

A sash lock apparatus which includes a keeper disposable on a first window sash and having a keeper aperture therein for lockingly receiving therein a selectively retractable element from a sash lock and the sash lock having the selectively retractable element disposable on a second window sash wherein the first and second window sashes are disposed for movement in a direction parallel to each other. The sash lock includes a rotatable lever having a tab extending therefrom and a spring slide deformable by rotation of the rotatable lever and movement of the tab against the spring slide for selectively causing a portion of the spring slide to enter and retract from the aperture to cause locking and unlocking of the first and second window sashes relative to each other. The spring slide includes a central aperture, the tab extending into the central aperture, rotation of the tab with the rotatable lever causing deformation of the spring slide and one of movement of the spring slide into or out of the keeper aperture. The housing has a shaft secured to the spring slide, the rotatable lever being rotatable about the shaft. The spring slide is preferably a spring steel slide. The apparatus may further include a member having member detents therein and secured to the shaft and rotatable member detents disposed on the rotatable member for entry into at least one selected member detent upon rotation of the rotatable member to one of an open or closed position.

20 Claims, 5 Drawing Sheets

SASH LOCK

CROSS REFERENCE TO PRIOR APPLICATION

This application claims priority under 35 U.S.C. 119(e) based upon provisional application Ser. No. 60/402,059, filed Aug. 9, 2002.

FIELD OF AND BACKGROUND OF THE INVENTION

This invention relates to a window or sash lock assembly and, more specifically to such an assembly which cannot be opened from the window exterior by potential burglars and the like.

The problem of securing windows and especially sash type windows from unlocking due to manipulation of the sash lock from the window exterior has been well known in the prior art and many potential solution of this problem appear in the prior art.

A first example of such a sash lock is shown in the patent of Subliskey (U.S. Pat. No. 6,116,665) which has a housing, a rotating assembly mounted in the housing, the rotating assembly including a handle rotatable in the housing and movable between open and closed position, a shaft connected to the handle and rotatable with the handle, a cam connected to the shaft, and contoured to engage a keeper, a slide plate mounted to the housing and slidable between a retracted position in which it is within the housing and an extended position in which it projects from the housing, a pin extending from one of the rotating assembly and the slide plate and a recess formed in the other of the rotating assembly and the slide plate, the pin and recess cooperating to drive the slide plate between its retracted and extended positions as the handle moves between its open and closed positions wherein the recess has a shape which causes the slide plate to be stationary during one part of the rotation of the handle as the handle moves between its open and closed positions and which causes the slide plate to move between its retracted and extended positions during another part of the rotation of the handle as the handle moves between its open and closed position. A problem with this device is that the two protruding guide rails into which the slide is snapped control the throw of the slide and can cause binding since the drive pin on the bottom of the cam that operates the slide is off center. If the slide binds, the sash lock will not securely lock the sashes or prevent the sashes from being opened. Also, since the slide is generally made of plastic material with no means of control of the vertical movement, and since the drive pin only protrudes about half way into the plastic slide, the pin may not stay in the drive hole, resulting in the slide either not projecting completely into the keeper, as intended, or not retracting from the keeper, resulting in the window remaining locked and inoperable.

A similar type of sash lock is disclosed by Rotondi (U.S. Pat. No. 6,142,541) wherein the lock is securable to a window sash of a double hung window, the lock having a base securable to that window sash. A cam is pivotable about a first axis relative to the base between an open position and a locking position, the cam pivoting in a first direction about the first axis when moving from the open position to the locking position and in the locking position including a portion extending from the base and adapted to cooperate with a keeper secured to the other window sash of the double hung window when the base is secured to the one window sash to lock the one window sash in a closed position relative to the other window sash. A guard member is pivotable about a second axis spaced from and substantially parallel to the first axis which is responsive to pivoting of the cam, the guard member being movable between a guarding position when the cam is in the locking position and a retracted position when the cam is in the open position. The guard member extends from the base to substantially overlap with the cam extending portion in the guarding position and the guard member does not substantially extend from the base in the position and the follower connection between the cam and the guard member pivoting the guard member about the second axis between the guarding position and the retracted position when the cam pivots about the first axis between the locking position and the open position, the follower connection being adapted to bias the cam toward pivoting in the first direction when a force biases the guard member toward the retracted position. As with the Subliskey patent discussed above, there is no means of controlling vertical movement of the unsupported end of the pivotal guard plate making it possible that the engagement pin on the underside of the cam can disengage from the pivotal guard plate, causing it to either not project/retract in part or in whole into/from the keeper respectively, thus preventing the window from locking or unlocking, respectively.

A patent to Mosch (U.S. Pat. No. 4,801,164) describes a check rail lock having a casing with a detent, a handle rotatable in the casing and held in a selected rotative position by a spring washer, a shaft rotatable by the handle, a cam rotatable between locked and unlocked positions the spring washer between the housing and cam and fastened to the shaft for rotation with the cam, the spring washer having an annular body with a generally concave configuration to provide a predetermined spring load on the handle, the annular body further having a pair of planar sections connected by a bend to adjacent sections thereof and detents embossed in the planar sections which coact with the detent. The spring design is complex and difficult to manufacture with consistent results due to the use of diametric detents on an opposing bi-planar surface opposite the concave face of the main spring body.

SUMMARY OF THE INVENTION

In accordance with the present invention, the above noted problems inherent in the prior art are overcome if not at least minimized by the sash lock in accordance with the present invention which presents an entirely new concept and minimized economics relative to the prior art.

The sash lock in accordance with the present invention does not require a track to guide the slide in either direction, the slide being spring loaded and therefore automatically throwing the slide once the rotation of the lever is started. Also, the use of a retaining ring at the bottom of the slide controls the vertical movement of the slide, allowing a positive engagement at all times of movement/rotation. Also, the spring design is flat with diametric detents on an outer ring, allowing for more feasible and cost effective spring production. An inner ring, which allows for a greater preload on the spring, provides a more positive audible snap when the lock is fully locked or unlocked and controls the outer ring.

Briefly, there is provided a keeper on an upper sash check rail, the check rail beings secured to the lower edge of the upper sash. The keeper is designed to receive therein a spring slide, preferably of spring steel, from the sash lock which is disposed on the upper surface of the lower sash check rail. When the spring slide is disposed external of the keeper, the window sashes can be moved relative to each other. However, when the spring slide is disposed within the keeper, the window sashes are prevented from movement relative to each other. The keeper contains a slot for receipt of the spring slide when the window sashes are in the entirely closed position with the spring slide coplanar with the slot in the keeper.

The sash lock is attached to an interior window check rail. The sash lock is assembled by placing a fixed detent spring around an axial shaft portion of the housing with detents on opposing sides of the spring entering a pair of notches on opposite sides of the upper surface of a lever/cam which is rotatable around the axial shaft portion. There are at least two pairs of spaced apart sets of notches on opposite sides of the cam upper surface. The lever/cam has an actuator stud on its lower surface which extends into a shaped interior section of the spring steel slide and, through an aperture at the center of the lever/cam and aperture in the form of a cam surface of the detent spring, is coupled to the axial shaft on the housing to lock all of the parts in place within the housing and prevent vertical movement of the locked parts. The positions of the window sashes can be reversed, if desired, though the arrangement as shown is the standard arrangement generally used.

DESCRIPTION OF THE PREFERRED EMBODIMENT

Figure 2:
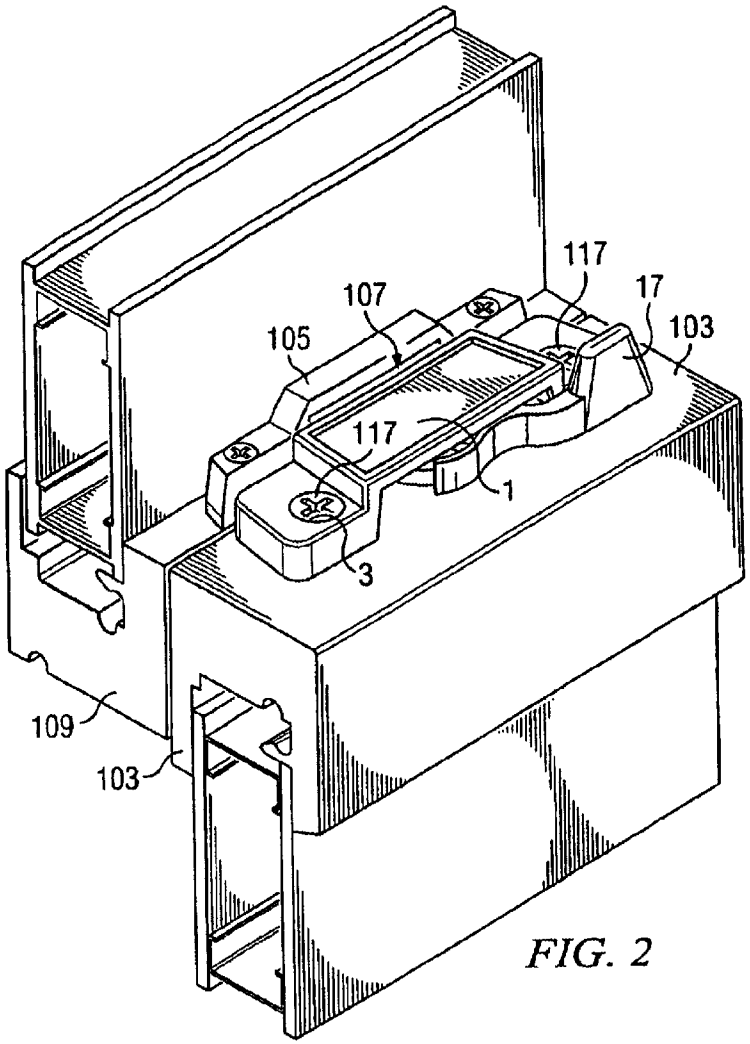
FIG. 2 is a perspective view of the embodiment of FIG. 1
Figure 1:
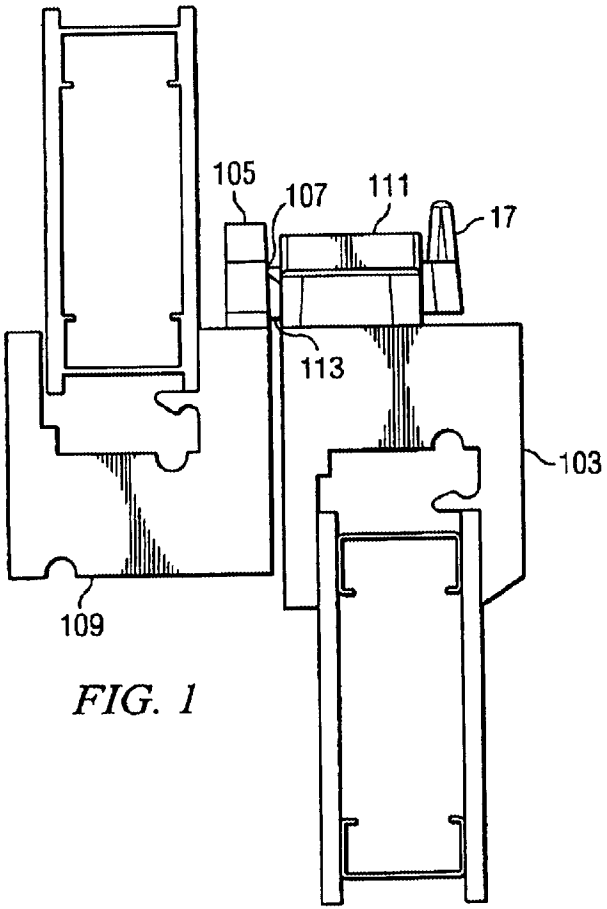
FIG. 1 is a side view of a pair of window sashes containing the invention in accordance with the present invention showing the sash lock and the keeper on opposing window sashes and FIG. 1*a* is a similar view of a second embodiment.
Figure 2A:
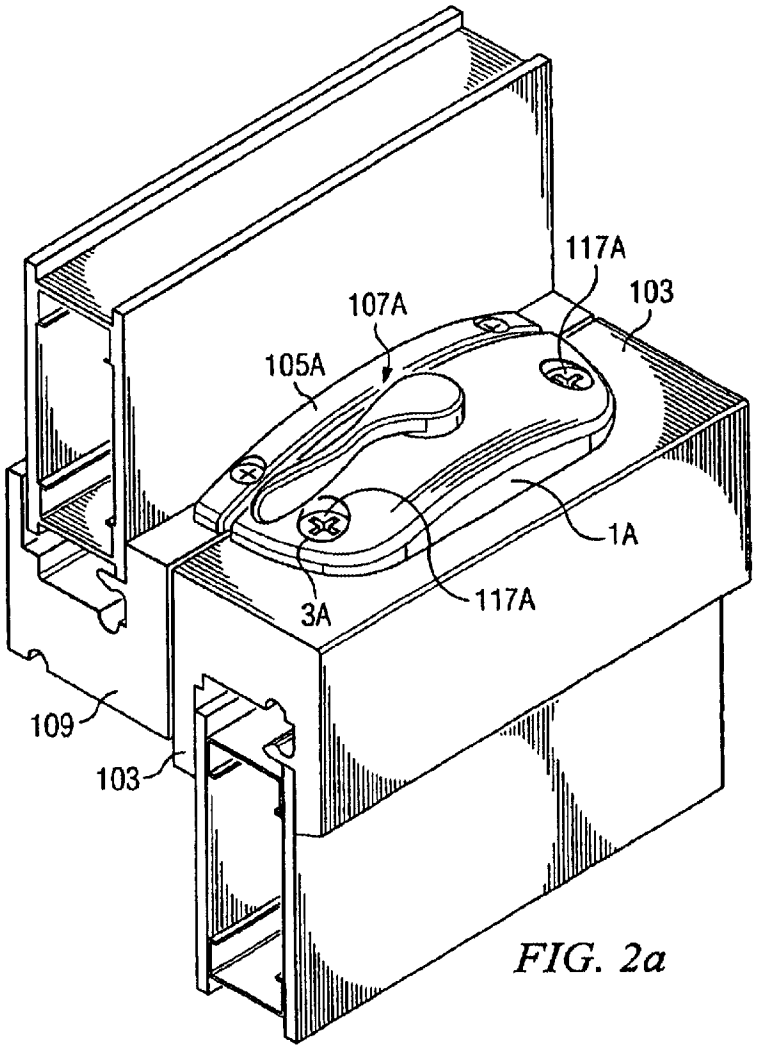
FIG. 2*a* is a similar view of a second embodiment.
Figure 1A:
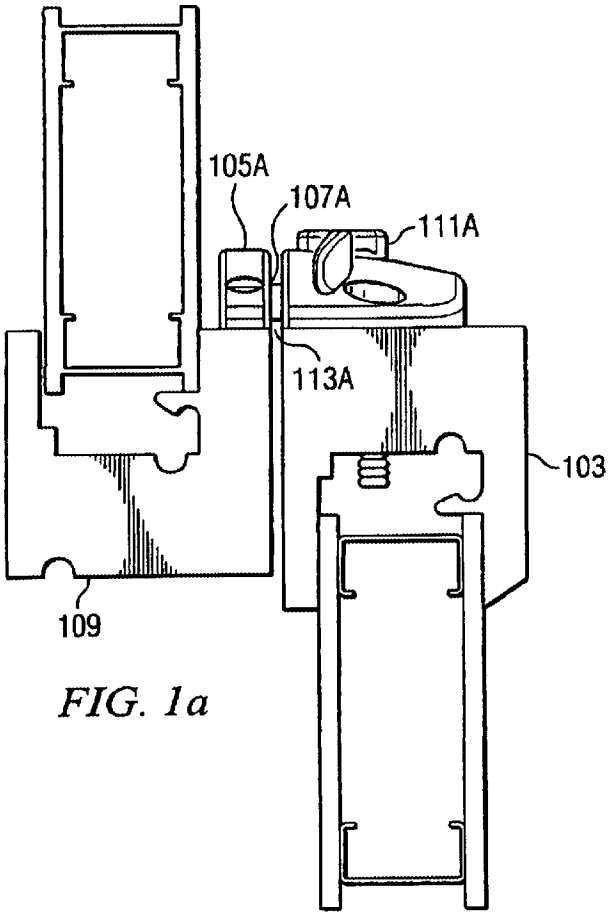

Referring to FIGS. 1 and 2, there are shown side and perspective views, respectively, of upper 109 (which is generally the outer) and lower 103 window sashes. A keeper 105 having a slot 107 is disposed parallel to the upper surface of the check rail of the upper sash 109 and secured thereto. The sash lock 111 contains a movable slide 113 (7 in FIG. 3), preferably of spring steel, and is disposed on the upper surface of the check rail of the lower sash 103.

Figure 3:
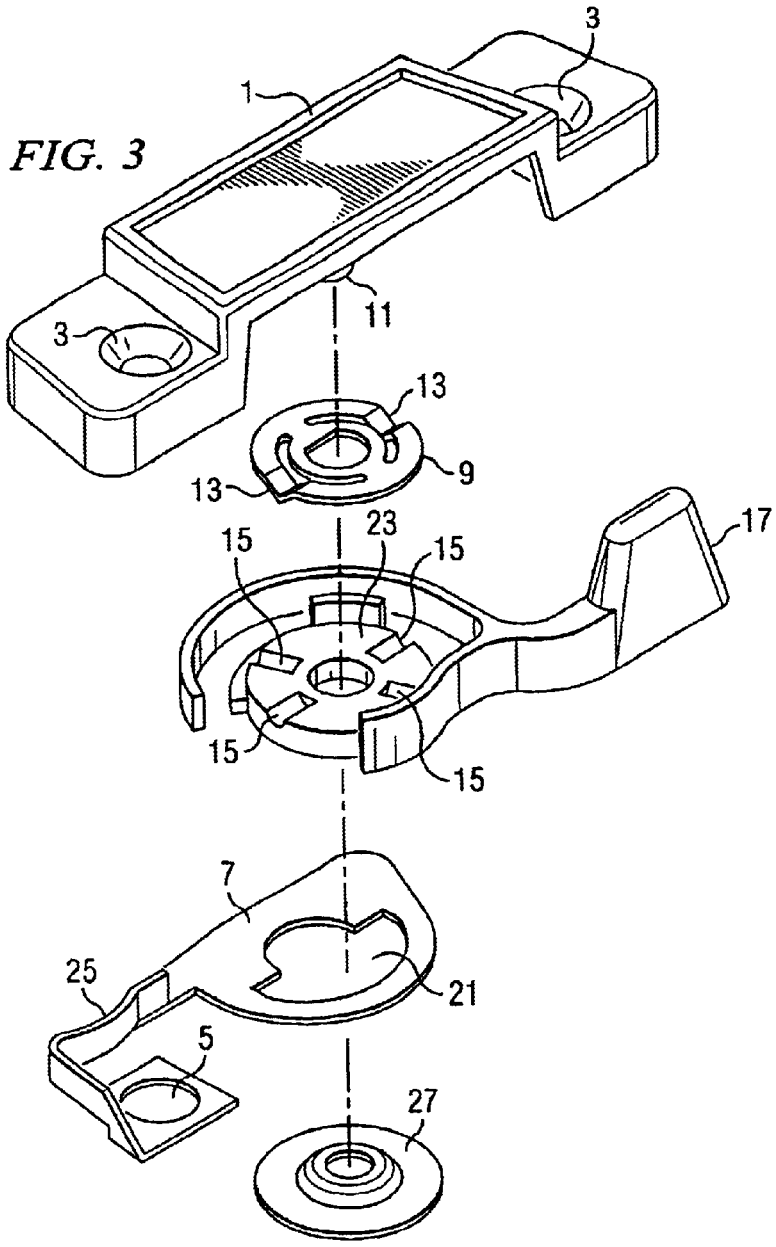
FIG. 3 is an exploded view of the sash lock assembly in accordance with the present invention and FIG. 3*a* is a similar view of a second embodiment.
Figure 4:
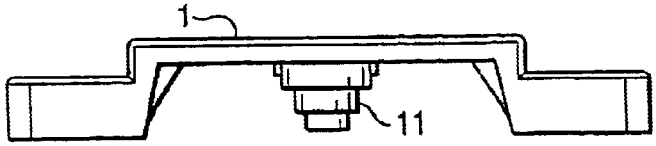
FIG. 4 is a front view of the housing 1 with axial shaft 11 depending therefrom and FIG. 4*a* is a similar view of a second embodiment.
Figure 3A:
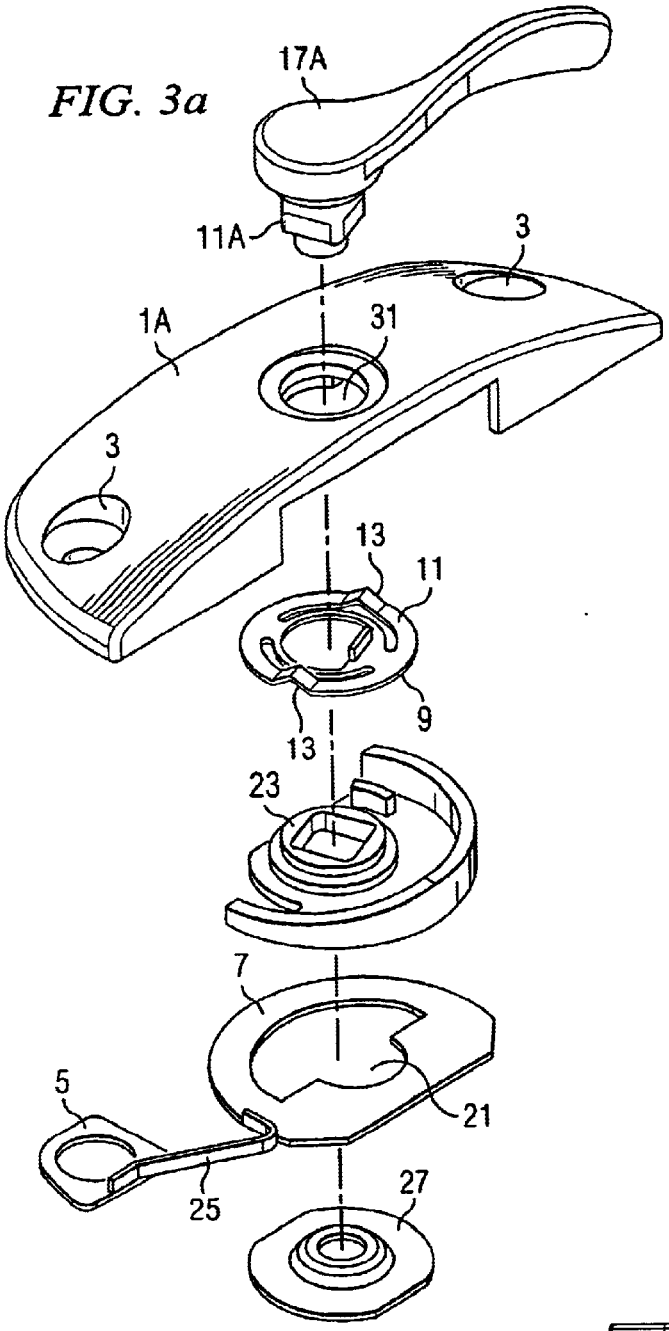
Figure 4A:
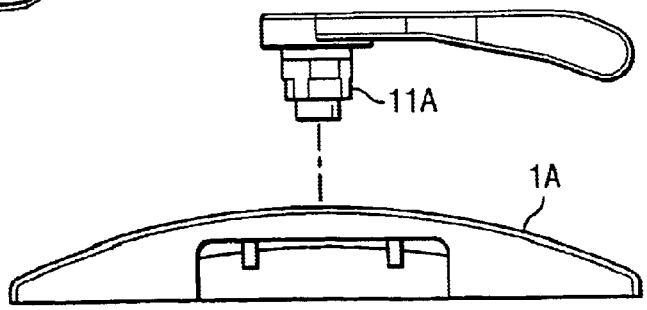
Figure 5:
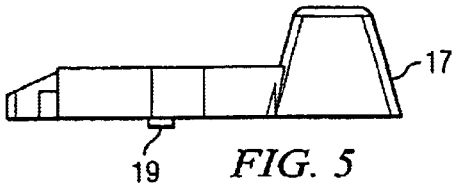
FIG. 5 is a front view of the lever/cam 17 with half moon actuator tab 19 depending therefrom and FIG. 5*a* is a similar view of a second embodiment.
Figure 5A:
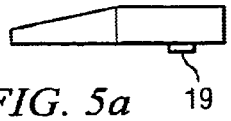

Referring now also to FIG. 3, there is shown an exploded view of the sash lock assembly 111 in accordance with the present invention. The sash lock assembly 111 is attached to an interior window check rail 103 by screws or the like 117 which pass through the screw holes 3 of the housing 1 and holes 5 in spring steel slide 7 (113). The lock is assembled by placing a fixed detent spring 9 around the fixed axial shaft portion 11 of the housing 1 (better shown in FIG. 4) with detents 13 on opposing sides of the spring 9 entering a pair of notches 15 on opposite sides of the upper surface of a lever/cam 17 which is rotatable around the fixed axial shaft portion 11. There are at least two pairs of spaced apart sets of notches 15 on opposite sides of the cam upper surface. The lever/cam 17 has an actuator pin or stud 19 (FIG. 5) on its lower surface which extends into a shaped interior section 21 of the spring steel slide 7. The lever/cam 17 is coupled to the axial shaft 11 on the housing 1 through aperture 23 at the center of the lever cam 17, the axial shaft 11 extending through aperture 21 or interior section 21 in the form of a cam surface of the detent spring 7 and being secured in retaining washer 27 to lock all of the parts in place within housing 1 and prevent vertical movement of the locked parts. The positions of the window sashes can be reversed, if desired, though the arrangement as shown is the standard arrangement generally used.

Figure 6:
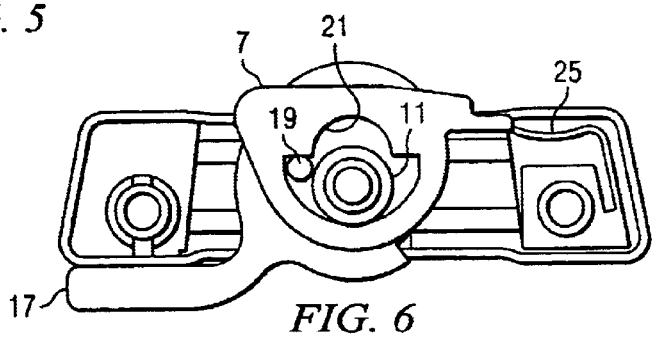
FIG. 6 is a partially cut away view of the sash lock in the locked position and FIG. 6*a* is a similar view of a second embodiment.
Figure 6A:
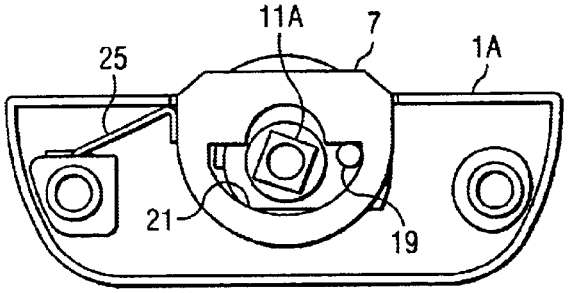

In operation, with the lever of the lever/cam 17 in the retracted or locked position as shown in FIG. 6, the half moon actuator pin or stud 19 (shown also in FIG. 5) on the bottom of the lever/cam 17 is shown disposed in the left hand corner of the shaped interior section 21 of the spring steel slide 7 where it applies no force to the spring steel slide and permits the spring steel slide to be in the rest position with the shaft 11 shown in the upward position within interior section 21 and with a portion of the spring steel slide 7 extending outwardly from the housing (note that the flat edge of the spring steel slide 7 extends beyond the housing 1 in FIG. 6). In this condition, the detents 13 of the detent spring 9 are disposed in a first pair of notches 15 in the lever/cam 17 associated with this locked condition.

Figure 7:
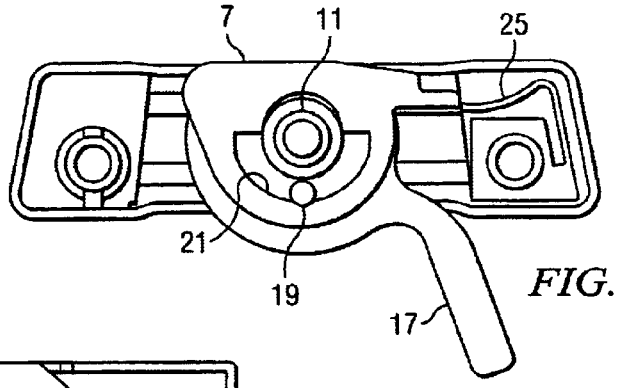
FIG. 7 is a partially cut away view of the sash lock in the un-locked position and FIG. 7*a* is a similar view of a second embodiment.
Figure 7A:
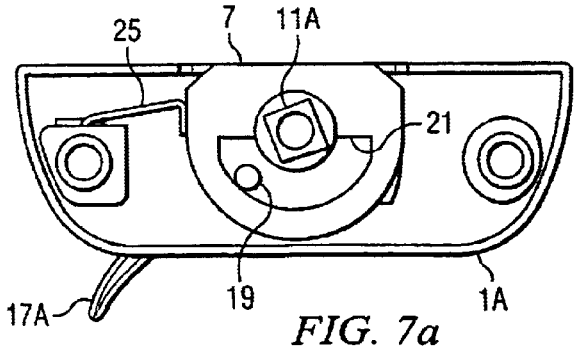

When the lever/cam 17 is rotated about ninety degrees (the amount of rotation is not critical and depends upon the construction) as shown in FIG. 7, the actuator pin or stud 19 moves with the lever/cam 17 and abuts the shaped interior section 21 of the spring steel slide 7 and applies an upward force on the spring steel slide, causing the spring steel slide to move within the housing 1 and to deform along the thin portion of the spring steel slide 25 where the spring steel slide is connected at its screw holes 5 to the remainder of the sash lock assembly. In conjunction with this lever/cam rotation, the detents 13 of the detent spring 9 move out of the first pairs of notches 15 in the lever/cam 17 and into a second pair of notches 15, providing an audible snapping sound and positive stop when entering the second pair of notches to indicate that the lever is now in the un-locked condition. The un-locked position is shown in FIG. 7 with the shaft 11 now positioned against the side of the shaped interior section 21 opposite the actuator 19 to also inhibit further movement. This permits a window in which the spring steel slide is disposed in the locked position to now be un-locked and capable of being opened. Return of the lever/cam to the position shown in FIG. 6 will again place the sash lock in the locked condition.

In accordance with a second embodiment of the invention, the same or similar parts are provided with the same character references as in the first embodiment and the figures corresponding to FIGS. 1 to 7 and shown as FIGS. 1A to 7A. In this embodiment, the housing 1A has a central aperture 31 extending therethrough and the position of the lever portion of the lever/cam 17A is altered to rest over the housing 1A and contains the axial shaft 11A positioned on the housing in the first embodiment. The cam portion of the lever cam is shown as 23A and contains a central aperture for lockingly receiving therein the axial shaft portion 11A of the lever 17A. As can be seen, the upper surface of the housing in this embodiment has curvature and the keeper 105A has curvature corresponding to that of the housing for aesthetic effect. The operation of the system is otherwise the same as described in connection with the embodiment of FIGS. 1 to 7.

Though the invention has been described with reference to a specific preferred embodiment thereof, many variations and modification will immediately become apparent to those skilled in the art. It is therefore the intention that the appended claims be interpreted as broadly as possible in view of the prior art to include all such variations and modification.

What is claimed is:

1. A sash lock apparatus which comprises:

a keeper disposable on a first window sash and having a keeper aperture therein for lockingly receiving therein a selectively retractable element from a sash lock and said sash lock having said selectively retractable element disposable on a second window sash, said first and second window sashes disposed for movement in a direction substantially parallel to each other, said sash lock including:

(a) a rotatable lever having a tab extending therefrom and rotatable in a plane substantially normal to the plane of movement of the second window sash, said tab extending in a direction parallel to the direction of movement of said second window sash; and (b) a spring slide deformable by rotation of said rotatable lever and movement of said tab against said spring slide for selectively causing a portion of said spring slide to enter and retract from said aperture to cause locking and unlocking of said first and second window sashes relative to each other.

2. The apparatus of claim 1 wherein said spring slide includes a central aperture, said tab extending into said central aperture, rotation of said tab with said rotatable lever causing deformation of said spring slide and one of movement of said spring slide into or out of said keeper aperture.

3. The apparatus of claim 1 further including a housing having a shaft secured to said spring slide, said rotatable lever being rotatable about said shaft.

4. A sash lock apparatus which comprises:

a keeper disposable on a first window sash and having a keeper aperture therein for lockingly receiving therein a selectively retractable element from a sash lock and said sash lock having said selectively retractable element disposable on a second window sash wherein said first and second window sashes are disposed for movement in a direction parallel to each other, said sash lock including:

(a) a rotatable lever having a tab extending therefrom; and (b) a spring slide deformable by rotation of said rotatable lever and movement of said tab against said spring slide for selectively causing a portion of said spring slide to enter and retract from said aperture to cause locking and unlocking of said first and second window sashes relative to each other, said spring slide including a central aperture, said tab extending into said central aperture, rotation of said tab with said rotatable lever causing deformation of said spring slide and one of movement of said spring slide into or out of said keeper aperture;

further including a housing having a shaft secured to said spring slide, said rotatable lever being rotatable about said shaft.

5. The apparatus according to claim 1 wherein said spring slide is a spring steel slide.

6. The apparatus according to claim 2 wherein said spring slide is a spring steel slide.

7. The apparatus according to claim 3 wherein said spring slide is a spring steel slide.

8. The apparatus according to claim 4 wherein said spring slide is a spring steel slide.

9. A sash lock apparatus which comprises:

a keeper disposable on a first window sash and having a keeper aperture therein for lockingly receiving therein a selectively retractable element from a sash lock and said sash lock having said selectively retractable element disposable on a second window sash, said first and second window sashes disposed for movement in a direction substantially parallel to each other, said sash lock including:

(a) a rotatable lever having a tab extending therefrom; and (b) a spring slide deformable by rotation of said rotatable lever and movement of said tab against said spring slide for selectively causing a portion of said spring slide to enter and retract from said aperture to cause locking and unlocking of said first and second window sashes relative to each other; said spring slide including a central aperture, said tab extending into said central aperture, rotation of said tab with said rotatable lever causing deformation of said spring slide and one of movement of said spring slide into or out of said keeper aperture;

further including a housing having a shaft secured to said spring slide, said rotatable lever being rotatable about said shaft;

further including a member having member detents therein and secured to said shaft and rotatable member detents disposed on said rotatable member for entry into at least one selected member detent upon rotation of said rotatable member to one of an open or closed position.

10. The apparatus according to claim 4 further including a member having member detents therein and secured to said shaft and rotatable member detents disposed on said rotatable member for entry into at least one selected member detent upon rotation of said rotatable member to one of an open or closed position.

11. The apparatus according to claim 7 further including a member having member detents therein and secured to said shaft and rotatable member detents disposed on said rotatable member for entry into at least one selected member detent upon rotation of said rotatable member to one of an open or closed position.

12. The apparatus according to claim 8 further including a member having member detents therein and secured to said shaft and rotatable member detents disposed on said rotatable member for entry into at least one selected member detent upon rotation of said rotatable member to one of an open or closed position.

13. A sash lock apparatus which comprises:

a keeper disposable on a first window sash and having a keeper aperture therein for lockingly receiving therein a selectively retractable element from a sash lock and said sash lock having said selectively retractable element disposable on a second window sash wherein said first and second window sashes are disposed for movement in a direction substantially parallel to each other, said sash lock including:

(a) a rotatable lever having a tab extending therefrom;

(b) means responsive to a predetermined rotation of said rotatable lever to provide an audible sound; and (c) a spring slide deformable by rotation of said rotatable lever and movement of said tab against said spring slide for selectively causing a portion of said spring slide to enter and retract from said aperture to cause locking and unlocking of said first and second window sashes relative to each other, said rotatable lever, in conjunction with said means responsive to a predetermined rotation providing an audible sound responsive to said predetermined rotation of said rotatable lever.

14. The apparatus of claim according to claim 1, further including means responsive to a predetermined rotation of said rotatable lever to provide an audible sound; said rotatable lever providing an audible sound in conjunction with said means responsive to a predetermined rotation of said rotatable lever.

15. The apparatus of claim according to claim 2, further including means responsive to a predetermined rotation of said rotatable lever to provide an audible sound; said rotatable lever providing an audible sound in conjunction with said means responsive to a predetermined rotation of said rotatable lever.

16. The apparatus of claim according to claim 3, further including means responsive to a predetermined rotation of said rotatable lever to provide an audible sound; said rotatable lever providing an audible sound in conjunction with said means responsive to a predetermined rotation of said rotatable lever.

17. The apparatus of claim according to claim 4, further including means responsive to a predetermined rotation of said rotatable lever to provide an audible sound; said rotatable lever providing an audible sound in conjunction with said means responsive to a predetermined rotation of said rotatable lever.

18. The apparatus of claim according to claim 9, said rotatable lever providing an audible sound responsive to a predetermined rotation of said rotatable lever.

19. The apparatus of claim according to claim 10, said rotatable lever providing an audible sound responsive to a predetermined rotation of said rotatable lever.

20. The apparatus of claim according to claim 12, said rotatable lever providing an audible sound responsive to a predetermined rotation of said rotatable lever.

* * * * *